US005524371A

United States Patent [19]

Hunter

[11] Patent Number: 5,524,371

[45] Date of Patent: Jun. 11, 1996

[54] DISPLAY APPARATUS

[76] Inventor: Richard S. Hunter, c/o Box 10162, Christchurch, New Zealand

[21] Appl. No.: 265,226

[22] Filed: Jun. 24, 1994

[30] Foreign Application Priority Data

Jun. 25, 1993 [NZ] New Zealand ..... 247997

[51] Int. Cl.[6] ..... G09F 7/00

[52] U.S. Cl. ..... 40/450; 40/492

[58] Field of Search ..... 40/447, 450, 492

[56] References Cited

U.S. PATENT DOCUMENTS

| | | | |
|---|---|---|---|
| 1,004,810 | 10/1911 | Newell, Jr. | 40/447 |
| 1,679,520 | 8/1928 | Giroux | 40/447 |
| 3,250,031 | 5/1966 | Bowman | 40/447 |
| 3,605,302 | 9/1971 | Muller | 40/447 X |
| 4,063,377 | 12/1977 | Hukill | 40/492 X |
| 4,539,768 | 9/1985 | Halliday | 40/447 X |
| 4,729,184 | 3/1988 | Cihanek | 40/447 X |

*Primary Examiner*—Peter M. Cuomo
*Assistant Examiner*—James O. Hansen
*Attorney, Agent, or Firm*—Christensen, O'Connor, Johnson & Kindness

[57] ABSTRACT

A display apparatus has a configuration of members rotatably mounted in a base. One face of each rotatable member is a different color or pattern to that of the base, whereas the other face is the same as the base. By selectively rotating the members, different letters and/or numbers can be formed by their contrasting faces. The base can be hingeably joined to a backing plate which is adapted to be fixed in any position where the display apparatus is to be located. Alternatively, the backing plate and base can be formed as an integral piece incorporating a flexible section between the backing plate and the base to function as a hinge. With either arrangement, the backing plate and base are pivotable relative to one another, wherein their edges can be clipped together to form a flat member. A plurality of these flat members can be joined together to form a panel or sign board.

8 Claims, 4 Drawing Sheets

A
B
1
2
3
4
4'
5
5'
6
7
12
19
20
21

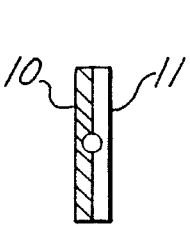
fig. 9.
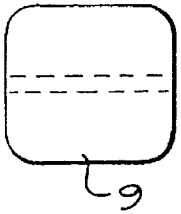
fig. 8.
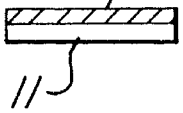
fig. 10.
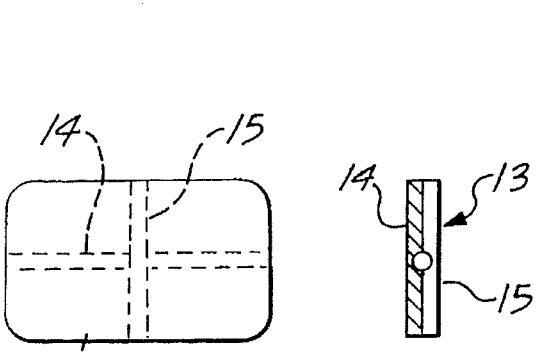
fig. 7.
fig. 5.
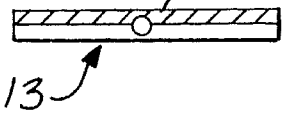
fig. 6.
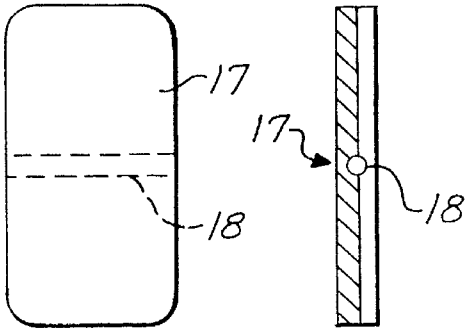
fig. 11.
fig. 13.
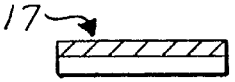
fig. 12.

DISPLAY APPARATUS

FIELD OF THE INVENTION

This invention relates to a display means more particularly an apparatus for displaying type face numbers and letters.

BACKGROUND OF THE INVENTION

It is common practice for traders to advertise or display the price of goods or services. Existing ways of displaying numbers include signs written on paper, blackboards or other display boards. Other ways include individual numbers printed on plastics sheet material which can be slotted into a holder and combined to form multi-digit numbers. Still further ways include costly electronic or liquid crystal displays. These existing methods often create calculator type digital letters and numerals from seven elements which for some letters and numerals form incomplete digits or letters.

It is an object of this invention to provide a display apparatus in which by manipulating some of the parts of the apparatus different type face numbers or letters can be seen.

A further object of the invention is to provide the public with a useful choice.

SUMMARY OF THE INVENTION

One aspect of this invention provides an apparatus with a base which has a configuration of rotatable members, one face of which is a different color or pattern to that of the base, the rotatable members being held in place relative to the base so that by rotating the members contrasting faces can be adopted to enable different letters and/or numbers to be formed by the contrasting faces.

The rotatable members are formed from two different colored parts, the parts being joined along a centre-line of the assembled member.

The colors of the base can be the same as one of the color of the members where the member is of more than one colors.

The preferably members are of two colors divided along a center-line of the assembled members.

Preferably eleven members are supported relative to the base with each of the eleven members being supported by transverse pins fitted in or to the base.

The eleven members can be of different sizes, for example there can be four small corner members, three similarly dimensioned transversely positioned members which extend between opposite corner members and four uprightly positioned members two of which extend in line between each of the opposite corner members, the third of the transversely positioned members extends across and between the center of the uprightly positioned members.

The base can be hingeably joined to a backing plate which is adapted to be fixed in any position where the display means is to be sited.

The backing plate can be formed integrally with the base and joined thereto by a flexible connection so that they pivot relative to each other and clip together to form a flat member.

In a further aspect this invention provides a method of using the apparatus by using the back in combination with contracting colored faces of the rotatable members to create numbers and letters.

Preferably in use the apparatus has the rotatable members configured generally to form approximately the outline of the numeral "8". By altering the orientation of the rotatable members a shape equivalent to most type face numbers or letters can be formed by the visual effect of the members contrasting against the base.

A number of similar bases can be configured to allow for multi-digit numbers or combinations of letter or words to be created.

DESCRIPTION OF THE DRAWINGS

FIG. 5 is a front view of a transverse member for incorporation in the display means.

FIG. 6 is a horizontal section through the transverse member shown in FIG. 5.

FIG. 7 is a vertical section through the transverse member shown in FIGS. 5 and 6.

FIG. 8 is a front view of an example of corner member for use in the display means.

FIG. 9 is a vertical section through the corner member shown in FIG. 8.

FIG. 10 is a plan view of the corner member shown in FIGS. 8 and 9.

FIG. 11 is a front view of an example of upright member for use in the display means.

FIG. 12 is a plan view of the upright member shown in FIG. 11.

FIG. 13 is a vertical section through the upright member shown in FIGS. 11 and 12.

FIG. 14 is an exploded perspective view showing how the parts of the rotatable members join together.

DESCRIPTION OF PREFERRED EMBODIMENTS

Embodiments of the invention will now be described by way of example only, with reference to the drawings.

The first and preferred embodiment of the present invention shown in the FIGS. 1 to 14 will be described with reference to the invention being used for a pricing system so that the type face FIG. '8' are used for creating numerals. It is however to be appreciated that with minor modifications the display means can be used for creating letters or other symbols.

The example shown in FIGS. 1 to 14 has its parts formed in an injection molding process. It is however to be appreciated that other methods of manufacture can be used as required.

Figures 1, 2, 3, 4:
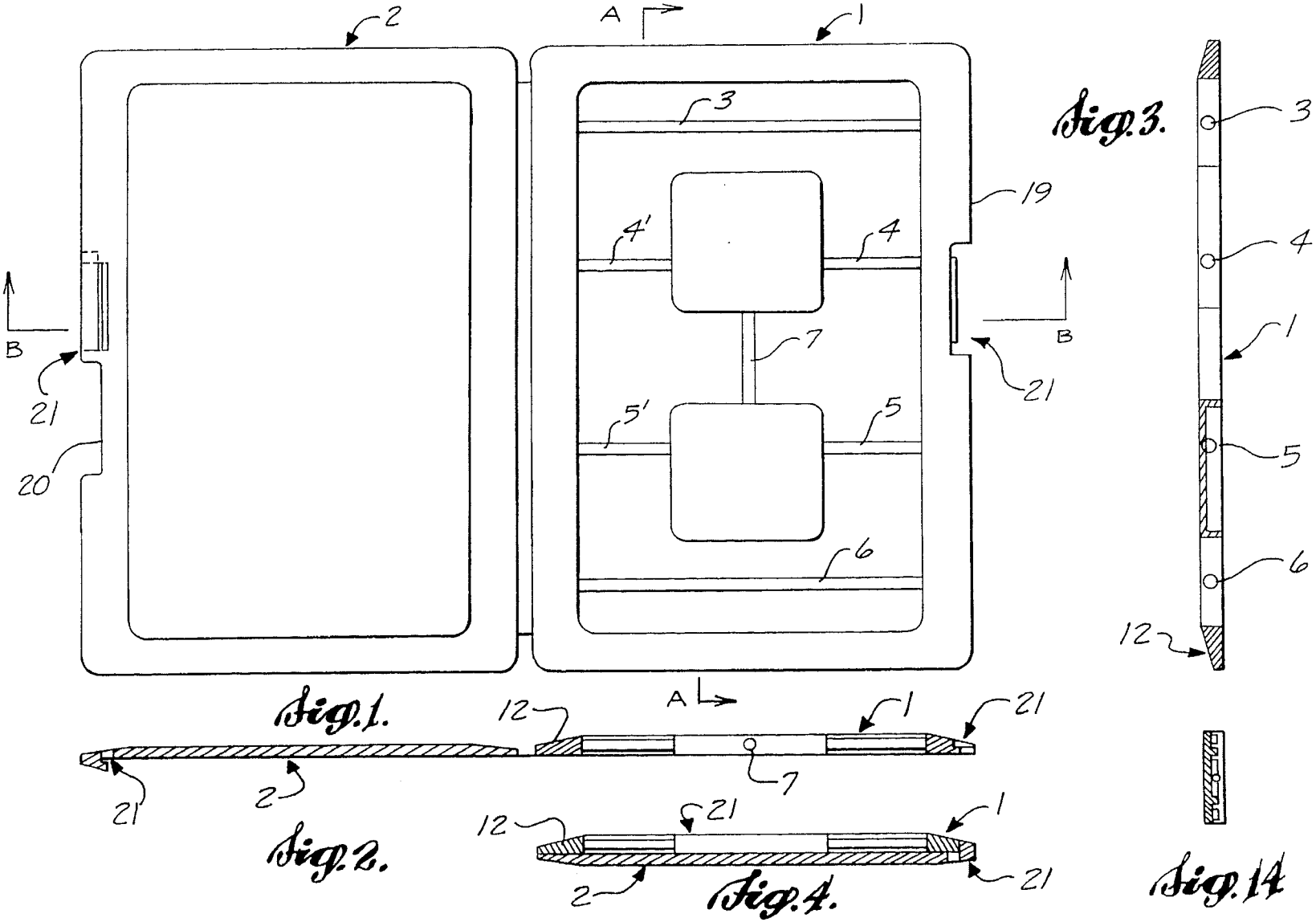
FIG. 1 shows a first view of a first example of the invention with the base and backing plate folded open.
FIG. 2 shows a sectional view on the lines B—B through the example of the invention shown in FIG. 1.
FIG. 3 shows a vertical sectional view on the lines A—A shown in FIG. 1.
FIG. 4 shows a sectional view of the example shown in FIGS. 1 to 3 with the base and backing plate clipped together.

In the example shown in FIG. 1 the display means consists of a base generally indicated by arrow 1 and a backing plate 2. The base is formed with six transverse pins 3, 4, 4', 5, 5' and 6 and one vertical pin 7. The base 1 is formed to have fitted therein on the pins 4, 4' and 5, 5' two blanks 8. The blanks 8 are supported in position by pin 7. The blanks 8 are not free to rotate.

The pin 3 has mounted thereon at either side (not shown in FIGS. 1 to 4) two corner members 9 shown in detail in FIGS. 8 to 10. The corner members are formed with opposite faces 10 and 11 which are of contrasting colors. One of the colors is the same as the outer face 12 (FIGS. 2 and 4) of the base 1 and the outer faces of the blanks 8. The pin 3 also supports one of the transverse members 13 shown in detail in FIGS. 5 to 7. The transverse member 13 has both horizontal and vertical holes 14 and 15 respectively. The pin 3 is in this position mounted in the hole 14. Again opposite faces of the member 13 are of contrasting colors.

The pin 6 has supported thereon a similar number of corner members 9 and a single transverse member 13 as with the pin 3.

The pins 4, 4' and 5, 5' have mounted thereon upright members 17 an example of which is shown in FIGS. 11 to 13. The upright member 17 has a transverse hole 18 which enables the parts forming the member 17 to be clipped together onto the pins 4, 4' or 5, 5'.

The manner in which the members 9, 13 and 17 are clipped together can be seen in FIG. 14. The interior contacting faces of the parts which form each of the members 9, 13 and 17 have engaging means so that the parts can be clipped together.

The pin 7 has mounted thereon one of the members 13 with the pin extending through the vertical hole 15.

The base 1 and backing plate 2 can be hingeably joined together by a flexible connection. This can be created by the plastic material from which the base 1 and backing plate 2 are molded.

The edges 19 and 20 respectively of the base 1 and backing plate 2 can incorporate clip means generally indicated by arrow 21 for joining them together in a snap-fit fashion. Details and the shape of this clip means 21 can be seen in FIGS. 2 and 4.

Figure 15:
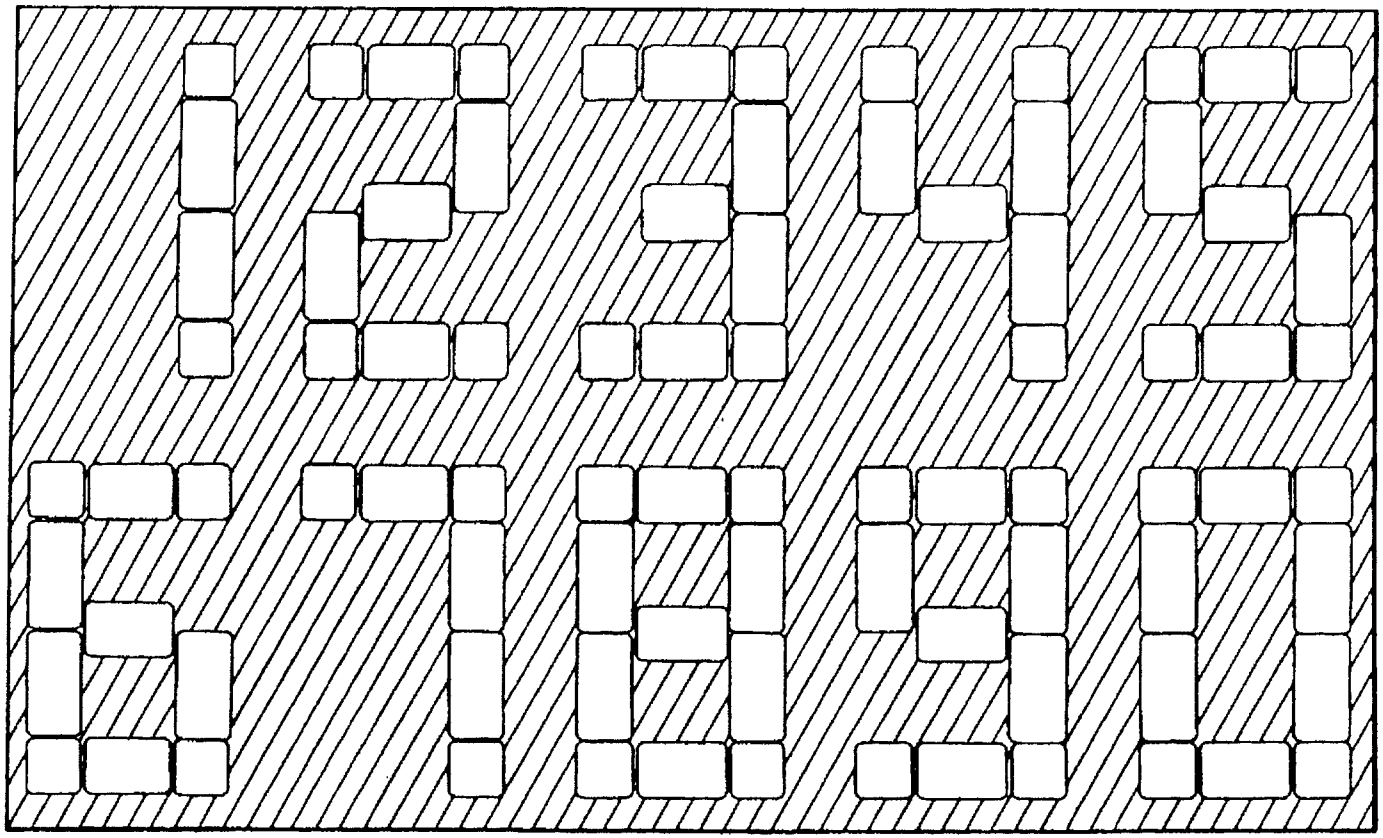
FIG. 15 is a front view of a sign board combining ten of the display means shown in FIGS. 1 to 14 together as a panel and showing the different numerals which can be formed by each display means.
Figure 16:
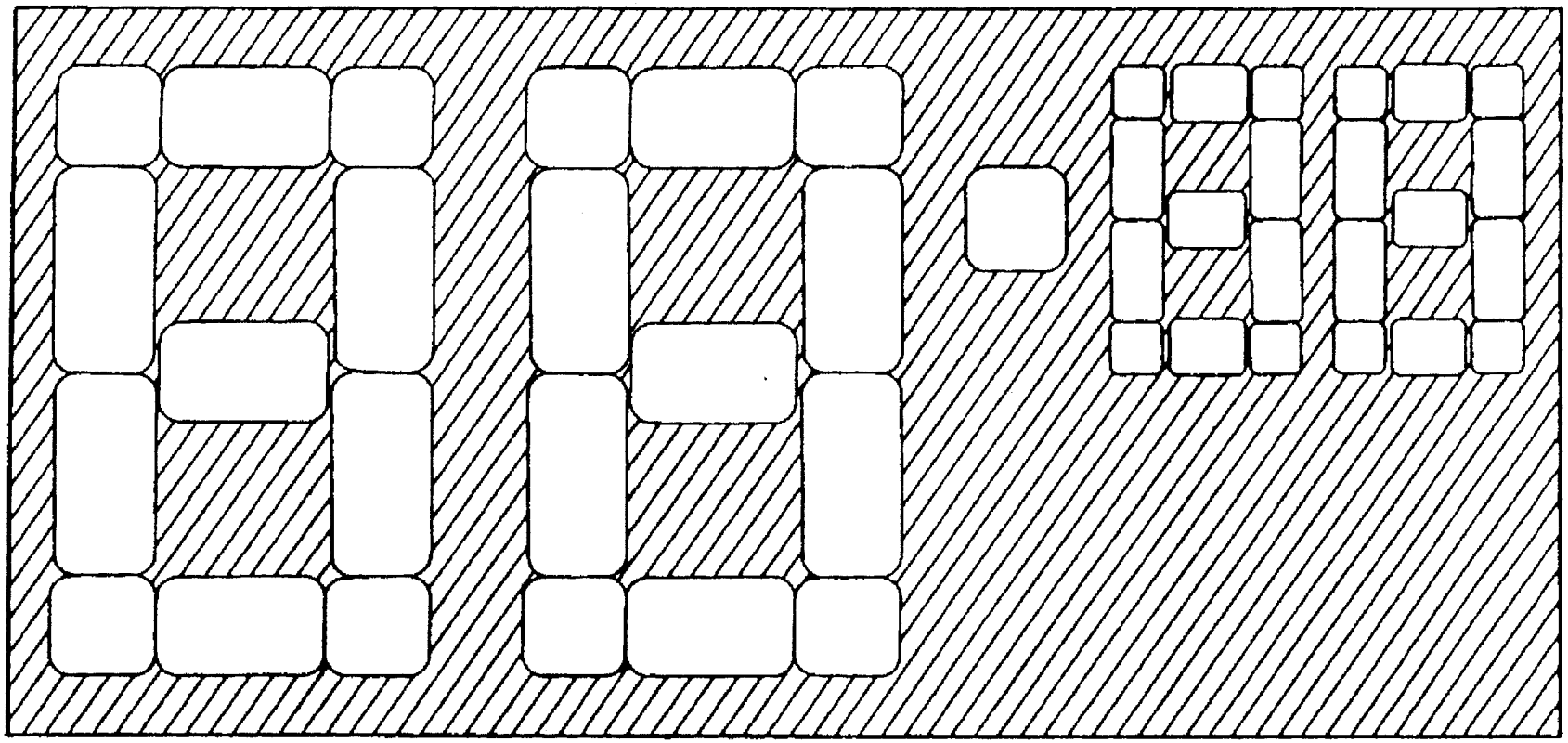
FIG. 16 shows a front view of an alternative example of sign board formed from display means which are of different size.

In use the base with the rotatable members 9, 13 and 17 fitted is freed from its clipping engagement with the backing plate 2 and moved to the position shown in FIGS. 1 and 2. In this position the rotatable members can be moved so that on the front face 12 a desired numeral or letter is seen. Examples of the numerals formed are shown in FIGS. 15 and 16. The numerals are seen in contrast by the faces shown and the base 12 of the base plate. When a desired numeral is shown the base is pivoted in the direction shown by arrow 21 in FIG. 2 so that it adopts the position shown in FIG. 4. A simple unclipping action is used to release the backing plate 2 from the base 1 of the backing plate whenever the number or letter is to be changed.

FIG. 15 shows a sign board panel 22 formed from ten different display means joined together to form a panel on which a variety of numeral or letters can be formed.

In FIG. 16 the sign board panel is formed from three display means, two of which are of the same size and the third of which is about half the size of the others.

It is to be understood that the scope of the invention is not limited to the described embodiments and therefore that numerous variation and modifications can be made to these embodiments without departing from the scope of the invention as set out in this specification and the accompanying claims.

What I do claim and desire to obtain by Letters Patent of the United States is:

1. A display apparatus for selectively displaying characters thereon, the display apparatus comprising:

(a) a base supporting a plurality of generally parallel pins;

(b) a plurality of rotatable members rotatably supported on the parallel pins, the rotatable members having a first face and a second face visually contrasting with the first face;

(c) a plurality of fixed members supported on the parallel pins, the fixed members being fixed relative to the base to prevent rotation of the fixed members on the parallel pins, the fixed members separating at least some of the rotatable members from one another; and (d) a transverse pin extending substantially orthogonally to the parallel pins, the transverse pin connecting between at least two fixed members.

2. The display apparatus of claim 1, wherein the fixed member is of a different size from any of the rotatable members.

3. The display apparatus of claim 1, wherein the transverse pin rotatably supports at least one rotatable member, the rotatable member supported by the transverse pin being rotatable about an axis transverse to the axis the other rotatable members rotate about.

4. The display apparatus of claim 1, wherein the rotatable members are of at least three different sizes.

5. The display apparatus of claim 4, wherein the fixed member is of a different size from any of the rotatable members.

6. A display apparatus for selectively displaying characters thereon, the display apparatus comprising:

(a) a base supporting a plurality of generally parallel pins;

(b) a plurality of rotatable members rotatably supported on the parallel pins, the rotatable members having a first face and a second face visually contracting with the first face, wherein the rotatable members are of at least three different sizes;

(c) first and second fixed members supported by the parallel pins, the first and second fixed members being disposed between at least some of the rotatable members wherein the first and second fixed members are fixed relative to the base to prevent rotation of the first and second fixed members relative to the base; and (d) a transverse pin substantially orthogonal to the parallel pins, wherein the transverse pin connects to each fixed member, and one of the parallel pins connect to each fixed member to prevent rotation of the fixed members.

7. The display apparatus of claim 6, wherein the fixed members are of a different size from any of the rotatable members.

8. The display apparatus of claim 6, wherein the transverse pin supports a rotatable member, the rotatable member supported by the transverse pin being rotatable about an axis transverse to the axis the other rotatable members rotate about.

* * * * *

UNITED STATES PATENT AND TRADEMARK OFFICE

CERTIFICATE OF CORRECTION

PATENT NO. : 5,524,371

DATED : June 11, 1996

INVENTOR(S) : R.S. Hunter

It is certified that error appears in the above-indentified patent and that said Letters Patent is hereby corrected as shown below:

| COLUMN | LINE | |
|---|---|---|
| 4 (Claim 8, | 63 line 4) | After "to the axis" insert --of-- |

Signed and Sealed this

Twenty-ninth Day of October 1996

*Attest:*

Bruce Lehman

BRUCE LEHMAN

*Attesting Officer*

*Commissioner of Patents and Trademarks*